US009789524B2

(12) United States Patent
Masunaga et al.

(10) Patent No.: US 9,789,524 B2
(45) Date of Patent: Oct. 17, 2017

(54) SHEAR SYSTEM OF EXTRUSION PRESS

(75) Inventors: Yoshikazu Masunaga, Ube (JP); Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 474 days.

(21) Appl. No.: 14/351,968

(22) PCT Filed: Aug. 3, 2012

(86) PCT No.: PCT/JP2012/069899
§ 371 (c)(1),
(2), (4) Date: Apr. 15, 2014

(87) PCT Pub. No.: WO2013/061666
PCT Pub. Date: May 2, 2013

(65) Prior Publication Data

US 2014/0260488 A1 Sep. 18, 2014

(30) Foreign Application Priority Data

Oct. 25, 2011 (JP) ..... 2011-233471

(51) Int. Cl.
*B21C 35/02* (2006.01)
*B21C 35/04* (2006.01)

(52) U.S. Cl.
CPC ..... *B21C 35/04* (2013.01); *B21C 35/02* (2013.01)

(58) Field of Classification Search
CPC ..... B21C 35/02; B21C 35/04
(Continued)

(56) References Cited

U.S. PATENT DOCUMENTS 5,127,224 A * 7/1992 Barcza ..... F23R 3/20 403/158
2010/0263428 A1* 10/2010 Yamamoto ..... B21C 35/04 72/255

FOREIGN PATENT DOCUMENTS

CN 101862761 10/2010
JP H073816 U * 1/1995 ..... B21C 35/04
(Continued)

OTHER PUBLICATIONS

Corresponding Office Action issued Dec. 31, 2014 of Chinese Application No. 201280044099.4 with English translation.

*Primary Examiner* — Teresa M Ekiert
*Assistant Examiner* — Gregory Swiatocha
(74) *Attorney, Agent, or Firm* — DLA Piper LLP (US)

(57) ABSTRACT

A shearing device for an extrusion press is adapted for cutting off from each other an extruded product and a discard which is the residue of a billet, the shearing device being configured so that the configuration thereof is simplified to reduce costs required for maintenance and production and so that the gap between the shear blade and an end surface of a die is automatically adjusted to improve the shearing accuracy, thereby providing a satisfactory cut surface. A shear cylinder (21) is mounted in a downward facing position to a frame (16) provided on the side of an end platen (11) which faces a container (10). A shear guide (18) is mounted to the frame (16) in a tiltable manner, the shear guide (18) having a shear blade (24) which is provided at the lower end thereof and guiding a shear slide (23). A tilt cylinder (19) for the shear guide (18) is mounted to the frame (16), the tilt cylinder (19) being capable of keeping the gap between the front face of a die stack (12) and the shear blade (24) constant by pressing the shear guide (18) against a horseshoe (26). The piston rod (22) of the shear
(Continued)

cylinder (21) is mounted to the shear slide (23) so as to be capable of tilting and sliding.

1 Claim, 4 Drawing Sheets

(58) Field of Classification Search
USPC ..... 72/254, 255, 263
See application file for complete search history.

(56) References Cited

FOREIGN PATENT DOCUMENTS

| | | | | |
|---|---|---|---|---|
| JP | 07-178447 | | 7/1995 | |
| JP | 10071420 A | * | 3/1998 | ..... B21C 29/04 |
| JP | 2005-537133 | | 12/2005 | |
| JP | 2010-247175 | | 11/2010 | |
| JP | 2010-284702 | | 12/2010 | |

* cited by examiner

SHEAR SYSTEM OF EXTRUSION PRESS

CROSS REFERENCE TO RELATED APPLICATION

The present invention claims priority from, and incorporates by reference the entire disclosure of, Japanese Patent Application No. 2011-233471, filed on Oct. 25, 2011.

TECHNICAL FIELD

The present invention relates to a shear system of an extrusion press for extruding aluminum alloy or another metal where the shear system separates a container from a die after an extrusion operation and cuts off a remaining part of a billet, referred to as, a "discard", at a front surface of the die to thereby separate the discard from the extruded product part.

Background Art

In the shear system of a conventional extrusion press, a shear cylinder for discard cutting-use is attached facing downward at a frame which is provided on a container side of a top part of an end platen which holds a die, and a shear blade is provided at the bottom end part of a piston rod of the shear cylinder through a shear slide.

In an extrusion press system which is provided with a shear system which is configured in this way, due to changes in temperature of the die and the clearance between a die assembly and die slide etc., the cutting blade surface of the shear blade does not become positioned in the same plane as the die end face. The position of the die end face fluctuates in a range of 0.5 to 1 mm or so. When cutting off the discard, if the clearance between the shear blade and the die end face grows wider, the cut surface of the discard will become poor and cutting burrs will be formed. When the container and die abut against each other to seal the container at the time of the next extrusion operation, the burrs will be interposed between the container seal surfaces and the container seal will become insufficient.

Further, if there is a ring-shaped port hole for the billet at the container side of the die, the aluminum alloy inside of the port hole will be gouged away at the time of cutting by the shear blade. At the time of the next extrusion operation, the air in the gouged away space will be entrained in the extruded product and bubbles, that is, blisters, will form at the extruded product. The cut end surface will not also be uniform but will have an uneven shape due to being gouged.

PLT 1 discloses art for solving this conventional problem by providing a shear cylinder for discard cutting-use, which is attached facing downward at a frame which is provided on a container side of an end platen which holds a die, so as to be able to tilt in an extrusion direction and counter extrusion direction, attaching to the frame a pushing device which has a tilting-use cylinder designed to enable adjustment of the clearance between the shear blade and the die end face and to a shear slide a guide roller device which can push the die to the end platen side, adjusting the clearance between the shear blade and the die end face to improve the cutting precision of the shear, and thereby obtaining a good cut surface. (See PLT 1.)

In this regard, in the above conventional type of extrusion press, the clearance between the die end face and the shear blade is secured before starting to cut off the discard. Further, the entire shear system is tilted by the pushing device so as to push the shear blade against the die end face when cutting off the discard. Due to this configuration, the shear cylinder, which is attached separated away from the pivot shaft of the shear system, can greatly swing. Hydraulic oil is supplied to the shear cylinder by a flexible hose which has pliability. This flexible hose has a shorter lifetime compared with metal piping and requires periodic replacement.

Furthermore, the configuration for attaching to the shear slide a guide roller which guides the shear blade and making the shear system as a whole tilt is complicated, so the shear system rose in cost.

CITATIONS LIST

Patent Literature

PLT 1: Japanese Unexamined Patent Publication No. 7-178447A

SUMMARY OF INVENTION

Technical Problem

The present invention is made to solve the above problem and has as its object the provision of a shear system of an extrusion press which simplifies the structure and reduces the cost involved in maintenance and production and which automatically adjusts the clearance between the shear blade and the die end face to improve the shear precision and thereby obtain a good cut surface when cutting apart the remaining part of a billet forming the "discard" from an extruded product part.

Solution to Problem

To achieve the above object, the shear system of the present invention is a shear system of an extrusion press, said shear system being adapted to cut an extruded product from a discard which is a remainder of the billet and comprising: a first fastening means for a die stack adapted to push and fasten the die stack in a cutting direction of a discard; and a second fastening means for the die stack adapted to push and fasten the die stack in an extrusion direction of a billet, characterized in that a shear cylinder which faces downward is attached to a frame which is provided on a container side of an end platen, a shear guide adapted to guide a shear slide is attached to the frame so as to be able to tilt, the shear guide being provided with a shear blade at its bottom end part, a tilt-use cylinder for the shear guide is mounted to the frame, said tilt-use cylinder being adapted to push the shear guide against a horseshoe to hold constant a clearance between a front surface of the die stack and the shear blade, and a piston rod of the shear cylinder is connected to the shear slide so as to be able to tilt and slide.

Advantageous Effects of Invention

The invention is configured to enable the die stack to be firmly fastened and tilt of the die stack to be prevented, so it is possible to make the shear blade and front surface of the die stack parallel at all times when removing the discard and possible to make the thickness of the cutting scraps of the discard uniform. Further, even if there is a variation in thickness of the die stack or elastic deformation of the shear frame, the invention is configured so that the shear blade automatically tracks this in position across the surface of the die stack, so it is possible to keep the clearance between the die stack end face and the shear blade constant at all times and keep the sharpness of the shear blade stable.

For this reason, uniform thickness of the cutting scraps of the discard can be achieved and blisters due to entrainment of impurities in the extruded product and leakage of the billet material from the container surface and die stack surface can be prevented. The product yield can also be improved.

The present invention will become more clearly understood from the attached drawings and the explanation of preferred embodiments of the present invention.

DESCRIPTION OF EMBODIMENTS

Figure 1:
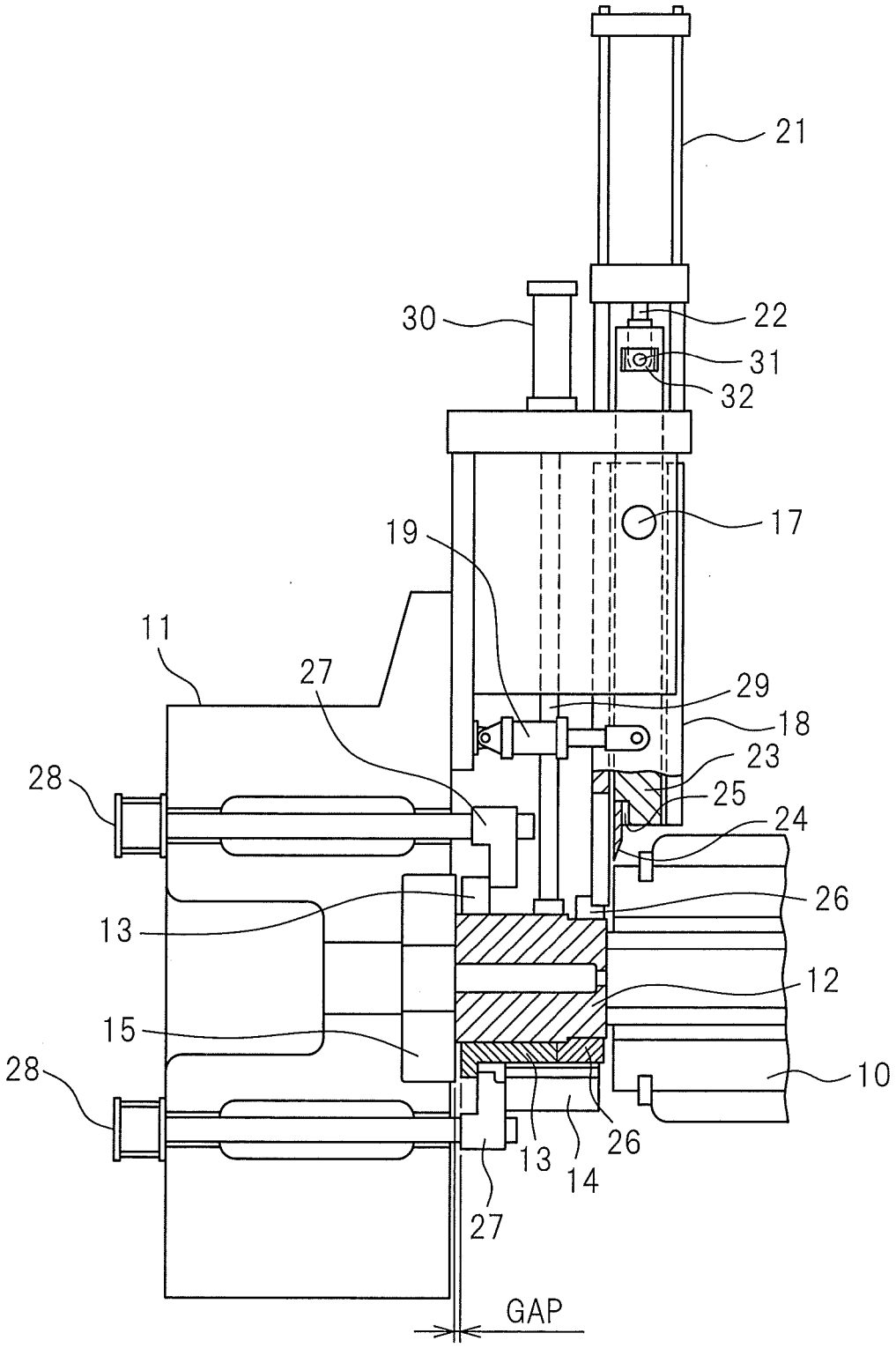
FIG. 1 is a longitudinal cross-sectional view of a shear system of an extrusion press for explaining an embodiment of the present invention.
Figure 2:
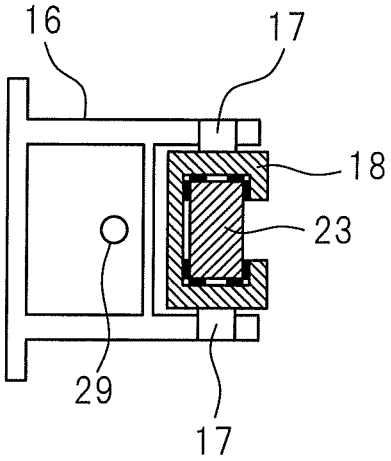
FIG. 2 is a view along the arrow A of FIG. 2.
Figure 3:
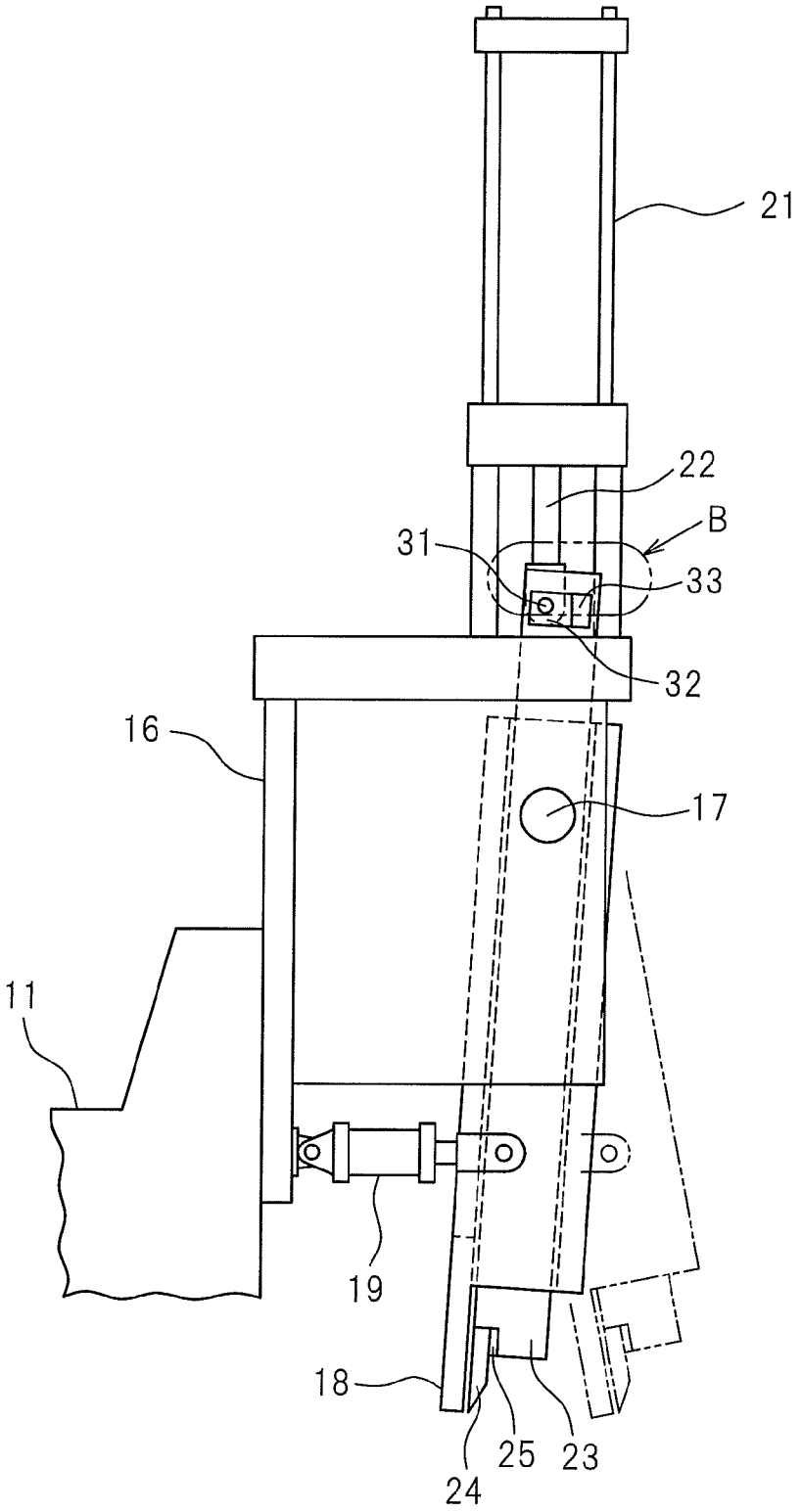
FIG. 3 is a view which explains swinging of a shear blade.

FIGS. 1 to 4 will be used to explain an embodiment of the present invention. In FIG. 1, reference numeral 11 indicates an end platen, 12 a die stack, 13 a die block, 14 a guide member which guides movement in a horizontal direction which is perpendicular with the paper surface of the figure of the die block 13, and 15 a pressure ring inside the end platen which receives the pushing force from the die stack 12. At the center parts of the pressure ring 15 and the end platen 11, holes are provided through which the product which is extruded from the die stack 12 passes. Note that, the die stack 12 is configured by a not shown plurality of parts.

At an upper container side of the end platen 11 which holds the die stack 12 at its front surface side, a shear frame 16 is attached. At the top end part of the shear frame 16, a shear cylinder 21 for discard cutting-use is attached. At part of the shear frame 16, a shear guide 18 is attached by a shaft 17 to be able to turn in the extrusion and counter extrusion directions. Reference numeral 22 is a piston rod. At the lower front end part of the piston rod 22, a shear slide 23 is connected so as to be able to slide inside the shear guide 18. Reference numeral 24 is a shear blade which cuts off the discard, while 25 is a shim which adjusts the clearance between the cutting surface of the die stack 12 and the shear blade 24. Reference numeral 10 is a container in which a billet is inserted.

The die stack 12 is housed in the die block 13. By pushing a die cassette which is configured by the die stack 12 and the die block 13 in the platen direction, the pressure ring 15 and the horseshoe 26 restrict movement in the horizontal direction. Due to the above mechanism, the die stack 12 is fastened to the end platen 11 through the horizontal direction arm 27 by the die stack horizontal fastening cylinder 28.

Further, by pushing by a vertical die clamp 29 at the same time, the die stack 12 can also be fastened in the vertical direction. The vertical die clamp 29 operates by a die stack vertical fastening cylinder 30.

The die stack 12 is set thicker than the die block 13, whereby even if thermal expansion of the die stack 12 etc. causes the thickness to fluctuate, it is possible to constantly firmly fasten the die stack 12 to the front surface of the end platen 11.

As shown in FIG. 1, the bottom end die stack side surface of the shear guide 18 pushes the container side end face of the horseshoe 26 by the shear slide-use swinging cylinder 19.

Due to this fastening action, the relative positions of the horseshoe 26 and the shear surface side of the die stack 12 can be kept constant at all times. Even while cutting off the discard after extrusion, due to this pressing action in the horizontal direction and pressing action in the vertical direction, the die stack 12 can be maintained at the same position at all times without moving.

The shear blade 24 which cuts off the discard is attached to the front end of the shear slide 23. This shear slide 23 is housed in the shear guide 18. The shear slide 23 is configured to swing about the shaft 17 and move up and down inside the shear guide 18.

Figure 4:
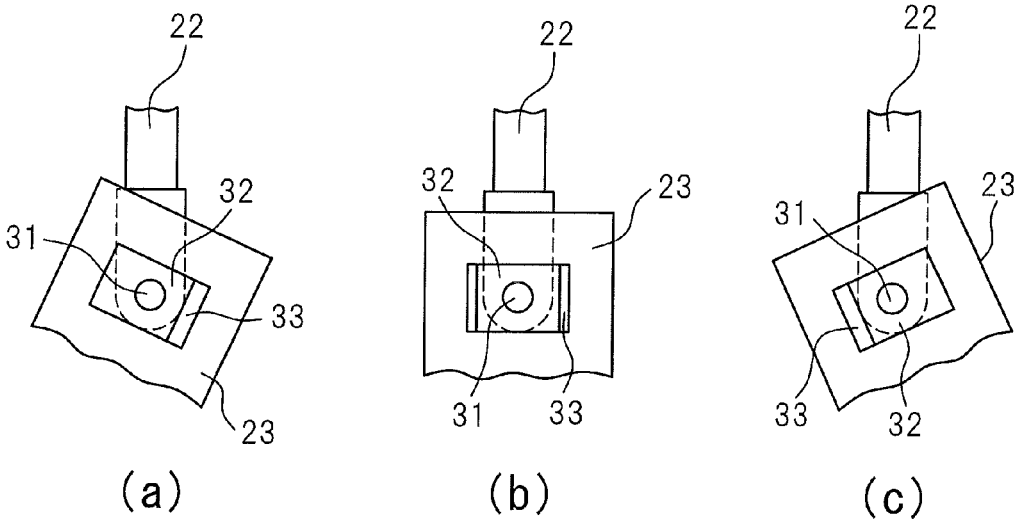
FIG. 4 is a view which explains a slide mechanism of a front end part of a shear cylinder of a part B of FIG. 3.

As shown in FIG. 4, the front end of the shear cylinder 21 and the shear slide 23 are provided with a pin 31 and slide piece 32, respectively, enabling the shear slide 23 to swing. The slide piece 32 swings in the slide hole 33 to hold the center position of the pin 31 in accordance with swinging of the shear slide 23.

FIG. 4(*a*) shows the state where the shear blade 24 has moved to the die stack 12 side, FIG. 4(*b*) shows the state where the shear slide 23 is vertical, and FIG. 4(*c*) shows the state where the shear blade 24 moves to the container side.

The shear cylinder 21 does not move even when the shear slide 23 swings due to the shear slide swinging cylinder 19 about the shaft 17. The hydraulic oil port can be connected by stationary piping, and therefore flexible hoses and other consumable members need not be connected.

The present invention is configured to enable automatic adjustment of the position of the shear blade so as to enable the clearance between the die stack surface and the shear blade, which would otherwise change due to fluctuation of the thickness of the die stack, to be kept constant at all times. This is performed by making the shear guide swing and push against the die stack. The clearance between the die stack surface and the shear blade surface when hot is adjusted by the shim 25 between the shear blade and the shear slide. The shim 25 is adjusted between the back surface of the shear blade 25 and the shear slide 23 so that when the die stack 12 is in the hot state, that is, the thickness of the die stack 12 is maximum in state, the shear slide swinging cylinder 19 may be operated to make the shear guide 18 and the horseshoe 26 abut and make the clearance between the die stack front surface and the shear blade 24, for example, 0.3 to 0.5 mm with the shear slide 23 becoming vertical.

In the shear action, a moment acts on the die stack surface making the shear blade 24 tilt to the die stack side, so the shear blade 24 acts on the die stack surface side at all times. At the start of the shearing action, the shear slide 23 is held by the action of the shear slide swinging cylinder 19.

Next, the action of this system will be explained. First, after the extrusion work is ended, as shown in FIG. 1, the container 10 and a not shown extrusion stem are made to retract to separate the container 10 from the die stack 12. By doing this, the remainder after extrusion of the not shown billet, that is, discard, appears at the end face of the die stack 12. In this state, the shear blade 24 etc. are at the rising limit position. Due to the die stack horizontal fastening cylinder 28 and the die stack vertical fastening cylinder 30, the die stack 12 is fastened in advance before extrusion. Next, due to the shear slide swinging cylinder 19, the shear guide 18 is made to move in the extrusion direction to a position where the front end of the shear guide 18 comes in contact with the horseshoe 26.

Due to this operation, the shear blade 24 can maintain the clearance from the front surface of the die stack constant at all times through the shear slide 23, shear guide 18, and horseshoe 26. Further, by adjusting the shim 25 between the shear blade 24 and the shear slide 23, it is possible to adjust the clearance between the die stack 12 and shear blade 24.

While holding this state, the shear cylinder 21 is made to operate to make the shear blade 24 descend. Due to the shear blade 24, the discard is cut off from the product.

The die stack 12 is fastened to the end platen 11 and die block 13 and tilt of the die stack 12 can be prevented, so when cutting off the discard, the shear blade 24 and the front surface of the die stack 12 can be kept parallel at all times and the cutting scraps can be made uniform in thickness.

After cutting off the discard, the shear slide swinging cylinder 19 is made to act to make the shear guide 18 turn slightly and separate from the horseshoe 26 and the shear cylinder 21 is made to operate to make the shear slide 23 and shear blade 24 rise. At the rising limit, the shear slide swinging cylinder 19 is made to act to return the shear guide 18 to a vertical state and end the cutting step of the discard.

This embodiment of the present invention is configured to make the front end of the shear guide 18 abut against the horseshoe 26 so as to maintain the clearance between the die stack 12 and the shear blade 24 constant, but the invention is not limited to this. For example, it may also be configured to make the front end of the shear guide 18 directly abut against the front surface of the die stack 12.

As explained above, the shear system of the present invention is configured so that even if there is a change of thickness of the die stack or elastic deformation of the shear frame, the position of the shear blade automatically tracks this over the entire die stack end face by the automatic adjustment mechanism of the shear blade. It is possible to constantly maintain a fixed clearance between the die stack end face and the shear blade and the shear blade can be stabilized in sharpness. For this reason, uniform thickness of the cutting scraps of the discard can be achieved, entrainment of impurities in the extruded product and leakage of the billet material from the container surface and the die stack surface can be prevented, and the product yield is improved.

The present invention is explained by reference to specific embodiments selected for the purpose of explanation, but it will be clear to a person skilled in the art that a large number of modifications are possible without departing from the basic idea and scope of the present invention.

REFERENCE SIGNS LIST

11 end platen
12 die stack
13 die block
14 guide member
16 shear frame
17 shaft
18 shear guide
19 shear slide swinging cylinder
21 shear cylinder
23 shear slide
24 shear blade
25 shim
26 horseshoe
27 horizontal direction arm
28 die stack horizontal fastening cylinder 28
29 vertical die clamp
30 die stack vertical fastening cylinder 30
31 pin
32 slide piece

The invention claimed is:

1. A shear system of an extrusion press, said shear system being adapted to cut an extruded product from a discard which is a remainder of a billet and comprising:

a first fastener for a die stack that pushes and fastens the die stack in a cutting direction of the discard; and a second fastener for the die stack that pushes and fastens the die stack in an extrusion direction of the billet, wherein a shear cylinder which faces downward is attached to a frame fixed to a container side of an end platen, a shear guide that guides a shear slide is attached to the frame to be able to tilt, the shear slide provided with a shear blade at a bottom end part, a tilt-use cylinder for the shear guide is mounted to the frame, said tilt-use cylinder adapted to pull the shear guide against a horseshoe to hold constant a clearance between a front surface of the die stack and the shear blade, and a piston rod of the shear cylinder is connected to the shear slide via a pin mounted on the piston rod and a slide piece pivotable on the pin and slidably engaged with the shear slide in a slide hole such that the shear slide is able to tilt and slide with respect to the piston rod.

* * * * *